US006316706B1

(12) United States Patent
Sammons

(10) Patent No.: US 6,316,706 B1
(45) Date of Patent: Nov. 13, 2001

(54) MULTI-PURPOSE ENTERTAINER STAND

(76) Inventor: Marvin L. Sammons, 165 Rainbow Dr., PMB 6540, Livingston, TX (US) 77399

( * ) Notice: Subject to any disclaimer, the term of this patent is extended or adjusted under 35 U.S.C. 154(b) by 0 days.

(21) Appl. No.: 09/709,094

(22) Filed: Nov. 10, 2000

(51) Int. Cl.[7] ..... G10D 3/00
(52) U.S. Cl. ..... 84/327; 84/421
(58) Field of Search ..... 84/327, 421, 453

(56) References Cited

U.S. PATENT DOCUMENTS

| | | | | |
|---|---|---|---|---|
| 432,305 | * | 7/1890 | Foley | 248/229.26 |
| 1,170,684 | * | 2/1916 | Schlieckert | 248/227.3 |
| 2,901,860 | * | 9/1959 | Crawford | 211/85.6 |
| 4,488,469 | * | 12/1984 | Demello et al. | 84/385 A |
| 4,943,182 | | 7/1990 | Hoblingre | 403/349 |
| 5,046,693 | | 9/1991 | Browne | 248/159 |
| 5,106,048 | * | 4/1992 | Lebar et al. | 248/460 |
| 5,149,905 | * | 9/1992 | Count | 84/744 |
| 5,744,735 | | 4/1998 | Liao | 84/327 |
| 5,799,919 | | 9/1998 | Orr | 248/398 |
| 5,893,541 | | 4/1999 | Michaelson | 248/158 |
| 6,007,032 | | 12/1999 | Kuo | 248/185.1 |
| 6,036,159 | | 3/2000 | Yu | 248/443 |

OTHER PUBLICATIONS

Eight (8) pages from the 1999 Ultimate Support Product Catalog.

* cited by examiner

*Primary Examiner*—Shih-Yung Hsieh
(74) *Attorney, Agent, or Firm*—Leydig, Voit & Mayer, LTD

(57) ABSTRACT

A multi-purpose entertainer stand comprises a central mast and a base, the base having a hub and a plurality of legs pivotally attached to the hub for supporting the stand. The hub is connected to the central mast. A main body is connected to the central mast and is vertically adjustable along the central mast. A pivot body is pivotally attached to the main body for supporting a microphone, the microphone being vertically adjustable by rotating the pivot body relative to the main body. A music easel is pivotally attached to the central mast for displaying sheet music. Preferably the hub and music easel are also vertically adjustable along the central mast.

21 Claims, 11 Drawing Sheets

FIG. 7a
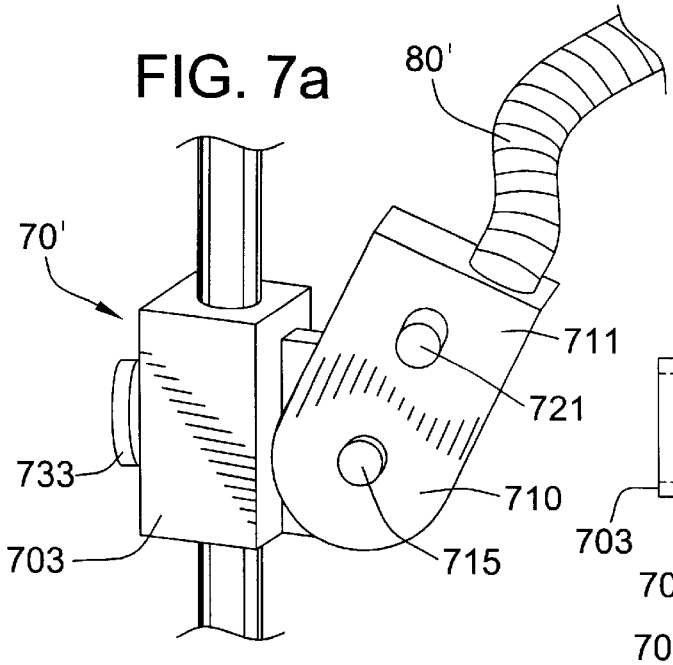
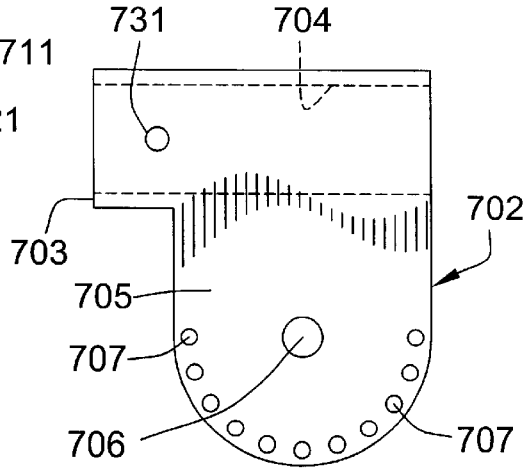
FIG. 7c
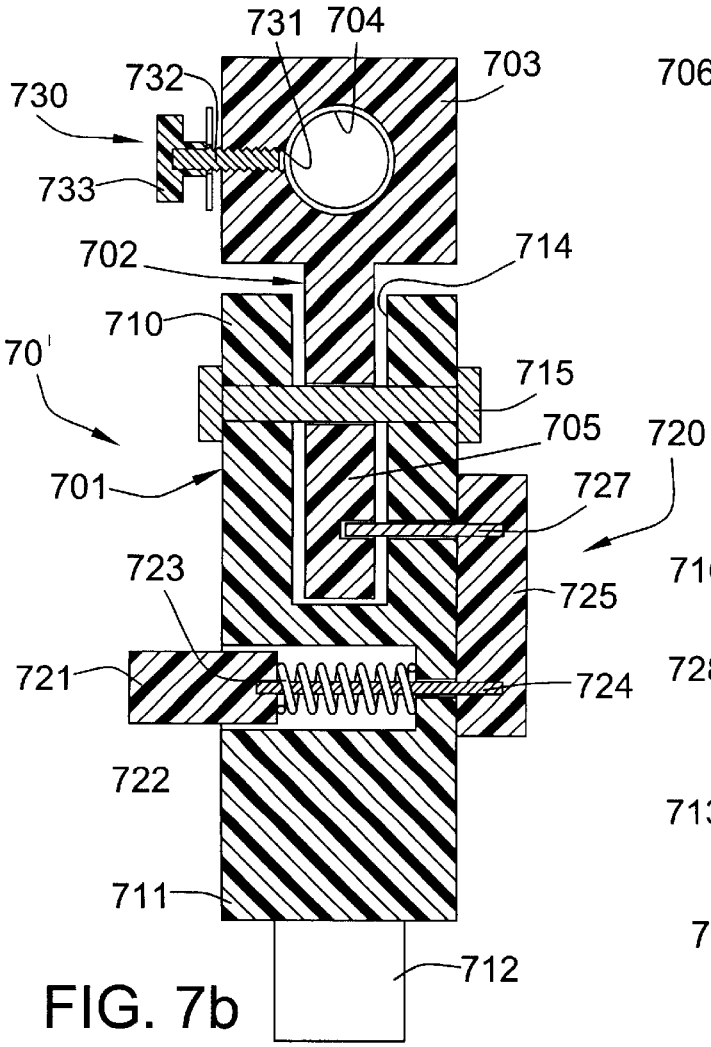
FIG. 7b
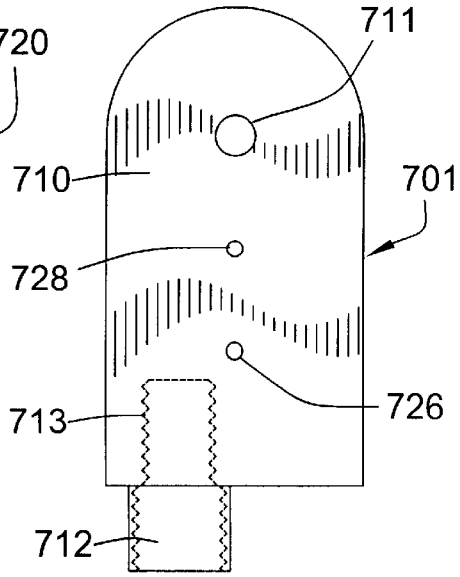
FIG. 7d

MULTI-PURPOSE ENTERTAINER STAND

FIELD OF THE INVENTION

The present invention relates generally to stands, and more particularly relates to entertainer stands for mounting musical items such as music, microphones, and instruments.

BACKGROUND OF THE INVENTION

Entertainers tour this country playing on successive nights in locations that may be in the next city or across the country. When this is the case, stage equipment is packaged every evening, transported and unpacked every day. In the case of stands, such as those for microphones or music, it has been found advantageous to provide stands which may quickly and easily be disassembled and re-assembled. For example, Michaelson, U.S. Pat. No. 5,893,541 discloses a microphone stand providing quick assembly and disassembly. It has also been found advantageous to provide music, microphones or instrument stands which are capable of being reduced in size for easier transportation. Such devices which accomplish this goal are typically collapsible or foldable to provide a more compact configuration for transport. For example, Kuo, U.S. Pat. No. 6,007,032 discloses a foldable stand assembly for microphones. Similarly, Liao, U.S. Pat. No. 5,744,735 discloses a folding guitar stand.

While these devices maybe folded down and/or quickly assembled and disassembled, they are generally limited to very specific purposes. Thus an entertainer or group of entertainers who utilize numerous instrument stands, music stands and microphone stands, a large amount of equipment is still required to be assembled and disassembled, and transported every evening. Additionally, too many stands can often interfere with each other. For example, when two or more musicians or singers are attempting to share a single piece of sheet music, the entertainers and/or their instruments may interfere with one another. If the entertainers attempt to prevent interference, the entertainers may not have a good view of the music or the audience may not have a good view of each entertainer.

SUMMARY OF THE INVENTION

In light of the above, it is a general aim of the present invention to provide a stand assembly which can simultaneously perform multiple functions. More particularly, it is an object of the present invention to provide a multi-purpose entertainer stand which can act as an instrument stand, a music stand, as well as a microphone stand.

In that regard, it is also an object of the present invention to provide an entertainer stand capable of supporting numerous microphones which are each independently and uniquely adjustable.

It is another object of the present invention to provide a multi-purpose entertainer stand accomplishing the above objectives while also capable of folding and collapsing into a compact configuration that is ideal for storage and transportation of the stand. It is a related object to provide quick-release couplings for connecting the various components of the stand in a manner that is quickly and easily assembled and disassembled.

In one embodiment of the invention, an entertainer stand comprises a central mast and a base, the base having a hub and a plurality of legs pivotally attached to the hub for supporting the stand. The hub is connected to the central mast and is vertically adjustable along the central mast. A main body is connected to the central mast and is vertically adjustable along the central mast. A pivot body is pivotally attached to the main body for supporting a microphone, the microphone being vertically adjustable by rotating the pivot body relative to the main body. A music easel is pivotally attached to the central mast for displaying sheet music. Preferably, the base's hub and the music easel are vertically adjustable along the central mast.

According to one aspect of the present invention, an instrument stand is provided. The plurality of legs include a first leg and a second leg, the first and second legs each including a foot pivotally connected thereto. The feet generally have a hook shape and are sized and spaced to receive the base of a guitar between the feet. A generally U-shaped neck is attached to the central support for supporting the guitar, the neck cooperating with the feet to provide support for a guitar. Preferably the neck is vertically adjustable along the central mast.

According to another aspect of the present invention, a microphone stand is provided. Preferably, a plurality of microphones are connected to the central mast and are independently usable and adjustable such that a plurality of entertainers may utilize the entertainer's stand. In one embodiment, a plurality of main bodies are connected to the central mast, the main bodies being vertically adjustable along the central mast and rotatably adjustable about the central mast. A plurality of pivot bodies are pivotally attached to the main bodies for supporting of plurality of microphones. The microphones are thus independently adjustable vertically as well as rotationally about both the central mast and the main body. In another embodiment of the invention, a single main body is connected to the central mast, the main body being vertically adjustable along the central mast and rotatably adjustable about the central mast. A plurality of pivot bodies are pivotally attached to the main body for supporting a plurality of microphones, the microphones being adjustable by rotating the pivot bodies relative to the main body. In a more detailed aspect of this embodiment, a plurality of risers are pivotally connected to the plurality of pivot bodies, the plurality of risers supporting the plurality of microphones. The microphones are thus independently adjustable both vertically and laterally by virtue of their connection to the central mast.

According to yet another aspect of the present invention, the entertainer stand may be quickly and easily folded down into a compact configuration. The plurality of legs are permitted to pivot about the hub to a position generally parallel with the central mast. The hub is vertically adjustable relative to the mast. The pivot body is pivotally attached to the main body for rotation to a position generally parallel with the central mast, the main body also being vertically adjustable along the mast. The music easel is foldable and vertically adjustable along the mast. In combination with the use of quick-release locking mechanisms, the entertainer stand may be quickly folded down into a compact configuration that is ideal for transportation and storage.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings:

FIGS. 7*a*, 7*b*, 7*c* and 7*d* depict another embodiment of the microphone module constructed in accordance with the teachings of the present invention;

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
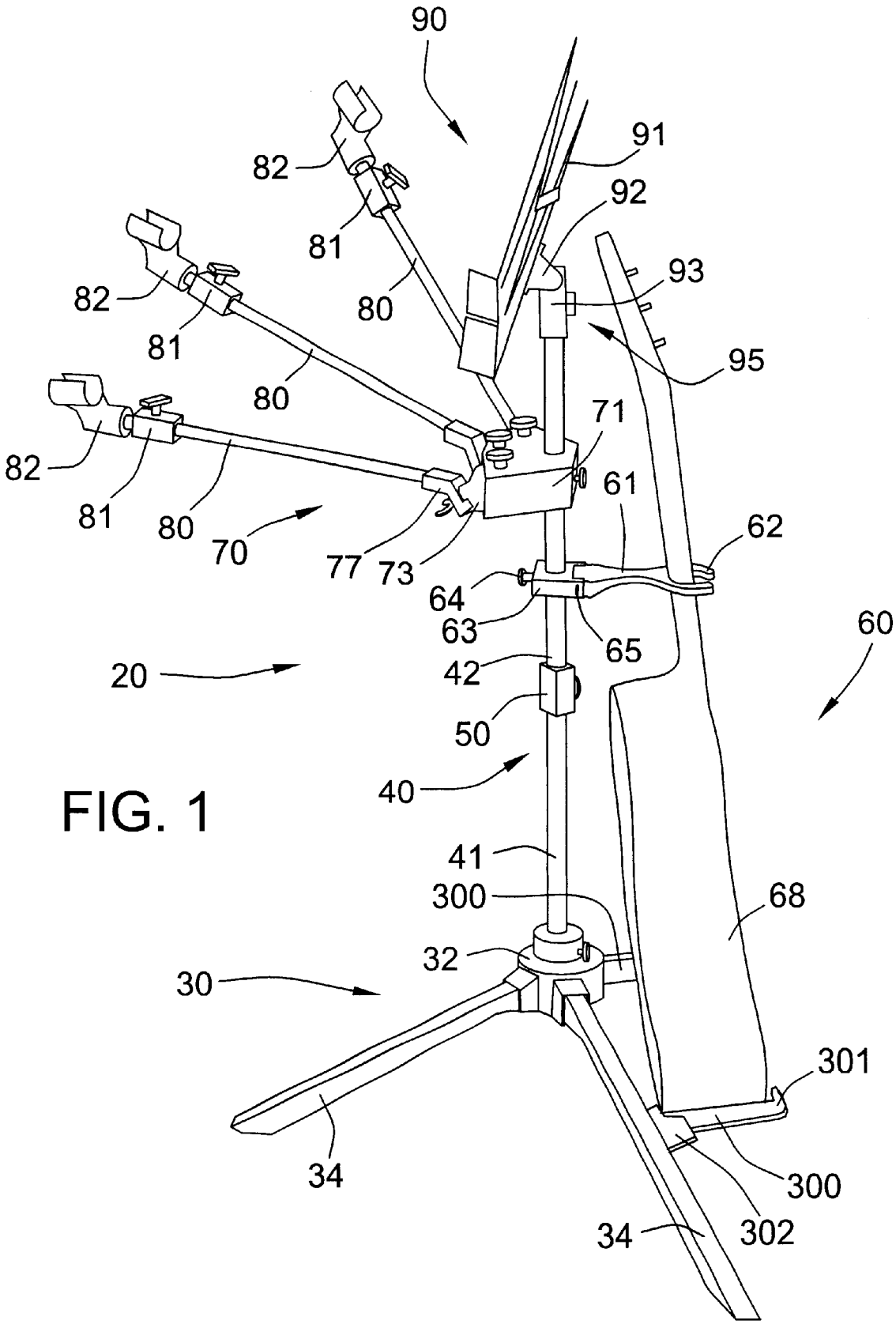
FIG. 1 is a perspective view of an embodiment of the entertainer stand constructed in accordance with the teachings of the present invention.

Referring now to the drawings, FIG. 1 illustrates an embodiment of the multi-purpose entertainer stand constructed according to the teachings of the present invention. The entertainer stand 20 can operate independently or simultaneously as a music stand, a microphone stand and/or a guitar stand. The stand 20 and its components are preferably adjustable so that they can be set in various positions of height. The stand 20 can accommodate multiple microphones which are independently and uniquely adjustable relative to one another so that multiple entertainers may not only share one microphone stand, but can also commonly utilize the music stand. The stand 20 is also advantageous in that it may be folded into a compact configuration that is ideal for transportation and storage.

The entertainer stand 20 generally comprises a stand base 30 which supports a vertically disposed central mast 40. In the preferred embodiment, the central mast 40 is comprised of two telescoping portions 41, 42. The upper mast portion 42 is vertically adjustable relative to the lower mast portion 41 by virtue of a coupler 50 having a quick-disconnect mechanism which will be discussed in more detail herein. The stand base 30 generally comprises a hub 32 and a plurality of legs 34, the hub 32 being connected to a downward end of the mast 40. The plurality of legs 34 are pivotally attached to the hub 32 and provide both vertical and lateral support to the central mast 40.

According to the invention, an instrument module 60, a microphone module 70, and a music module 90 are supported on the stand 20 to provide a multi-purpose entertainer stand 20. The preferred instrument module 60 generally comprises two feet 300 provided on two of the legs 34. The feet 300 cooperate with a neck 61 to provide an instrument stand, such as the illustrated guitar holder. With regard to the microphone module 70, a main body 71 is connected to the mast 40, and in the illustrated embodiment has a plurality of microphone booms 80 pivotally attached thereto for providing one or multiple microphone stands. Finally, the music module 90 includes a music easel 91 connected to the central mast 40 and is adjustably disposed so that an entertainer utilizing the microphone module 70 may view music or other information held on the easel 91.

Figure 2:
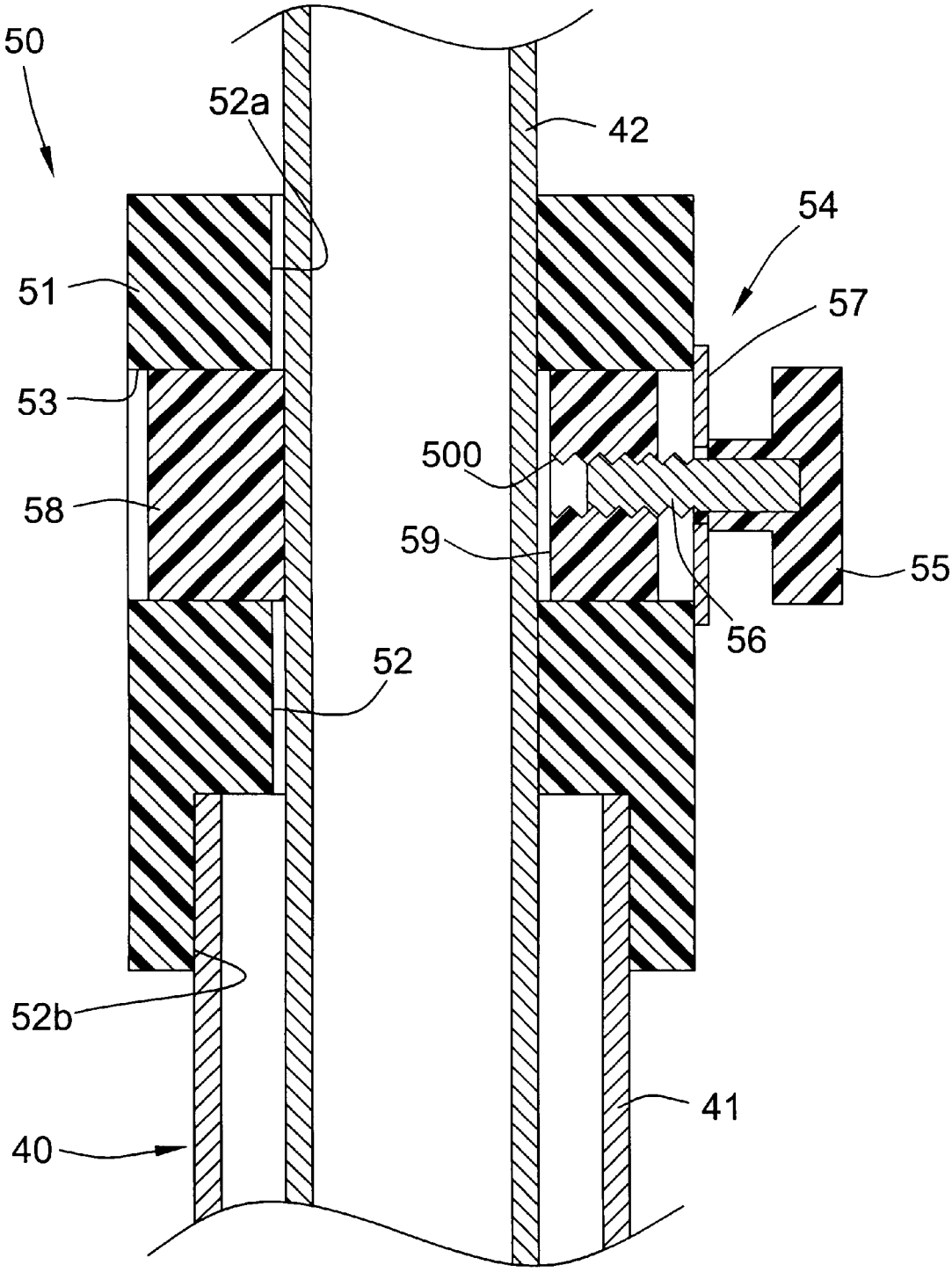
FIG. 2 is a cross-sectional view, partially cut-away, of an embodiment of the quick-release locking mechanism constructed in accordance with the teachings of the present invention.

In accordance with an aspect of the present invention, a quick-disconnect locking mechanism is utilized to promote the rapid assembly and disassembly of the entertainer stand 20. Turning attention to FIG. 2, a cross-sectional view of the connector or coupler 50 is illustrated. The coupler 50 generally includes a tubular body 51 having a stepped tubular aperture 52 extending along longitudinally through the body 51 and including a first cylindrical aperture portion 52*a* having a diameter slightly less than a second cylindrical aperture portion 52*b*. The larger cylindrical portion 52*b* is sized to closely receive the lower mast portion 51 of the central mast 40. The upper mast portion 42 passes downwardly through the first aperture portion 52*a* and into the lower mast portion 41, thereby providing a telescoping central mast 40. The first aperture portion 52*a* is sized slightly larger than the upper mast portion 42, permitting the latter to slide vertically relative to the coupler 50 and lower mast portion 41.

The quick disconnect mechanism is indicated generally at 54 includes a knob 55 having a threaded rod 56 projecting therefrom, a washer 57, and a peg or cylinder 58. The connector body 51 includes a cylindrical hole 53 extending through the width of the body 51, generally perpendicular to the longitudinal axis of the body 51. The cylinder 58 is slidably received within the cylindrical hole 53 and itself includes a cylindrical aperture 59 extending transverse to the longitudinal access of the cylinder 58 and parallel with the longitudinal axis of body 51 and its aperture 52. The cylindrical aperture 59 of the cylinder 58 is sized to slidably receive the upper mast portion 42. The cylinder 58 also includes an internally tapped hole 500 which receives the threaded rod 56 connected to the knob 55. The threaded rod 56 extends through a washer 57, the washer 57 sized to engage the outer surface of the connector body 51. The rod 56 threadingly engages the internal hole 500 in the cylinder 58.

In operation, the knob 55 is flush against the washer 57 and when screwed into the cylinder 58 it draws the cylinder laterally towards the knob 55 as the threaded rod 56 moves further into the threaded hole 500. The cylindrical hole 59 in the cylinder 58 will engage an outer surface of the upper mast portion 42 and press the opposing side of the mast portion 42 against the wall of the cylindrical opening 52*a* in the connector body 51. In this position, the upper mast portion 42 is frictionally restricted from vertical movement relative to the connector 51 and lower mast portion 41. To permit vertical adjustment of the upper mast portion 42, the knob 55 is rotated to draw the threaded rod 56 outwardly from the threaded hole 500 in the cylinder 58. As the knob 55 is rotated, the cylinder 58 is permitted to shift laterally towards center such that the cylindrical hole 59 is substantially aligned with the cylindrical hole 52*a* in the connector body 51, permitting the upper mast portion 42 to slide freely. It can therefore be seen, that merely rotating the knob 55 a short distance can quickly allow the central mast 40 to be extended or shortened for rapid assembly and disassembly. This quick-disconnect locking mechanism 54 can be utilized throughout the entertainer stand 20 for rapid attachment and assembly of the various components, as well as detachment and disassembly. Alternate embodiments of the quick-disconnect mechanism 54 will also be shown and described herein.

Figure 3:
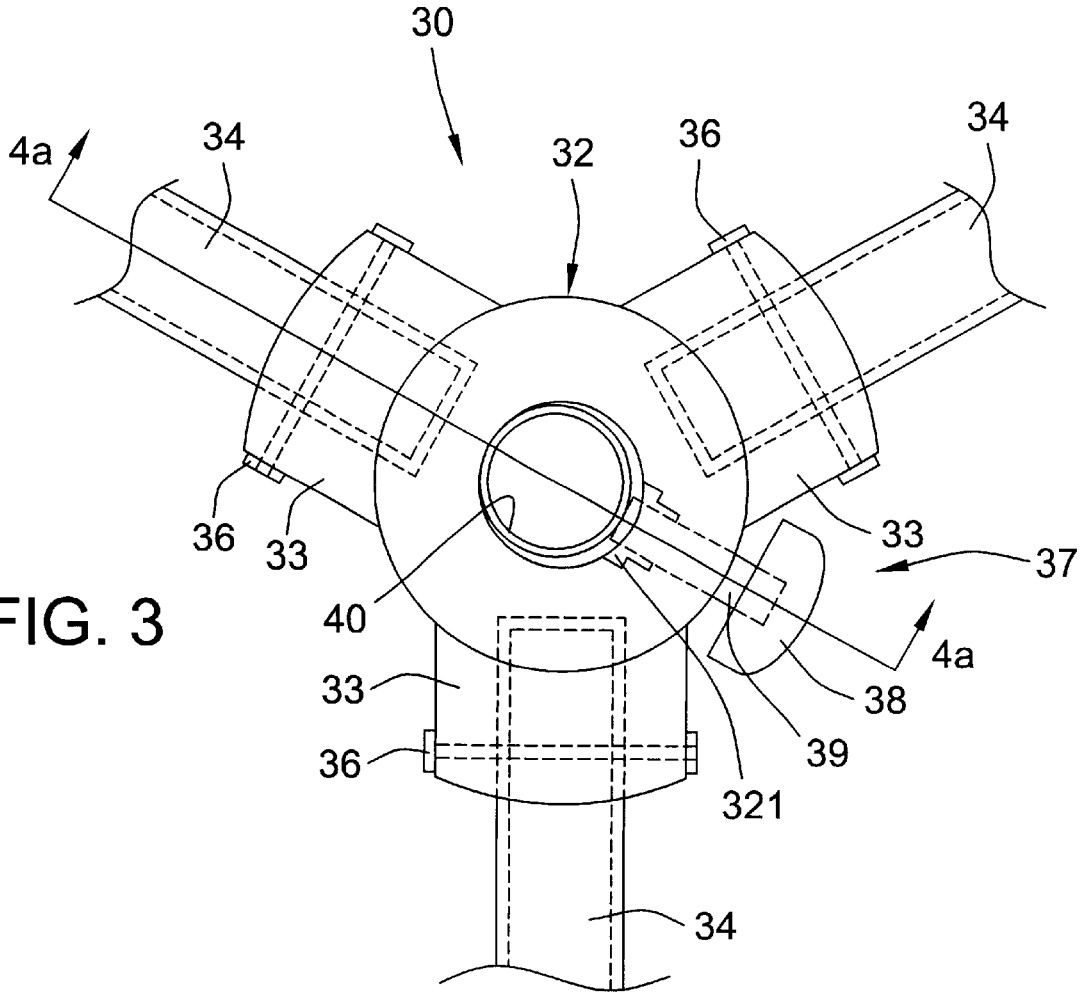
FIG. 3 is a top view, partially cut-away, of the stand base of FIG. 1.
Figure 4A:
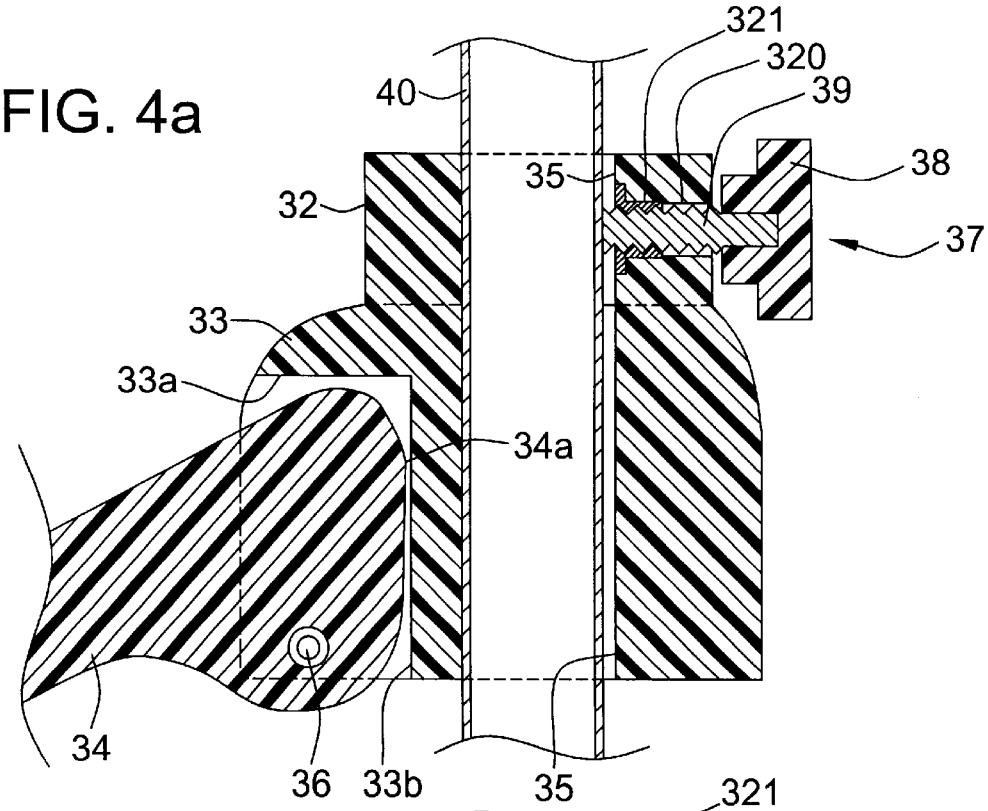
FIGS. 4*a* and 4*b* are cross-sectional views, partially cut-away, of the stand base of FIG. 3.
Figure 4B:
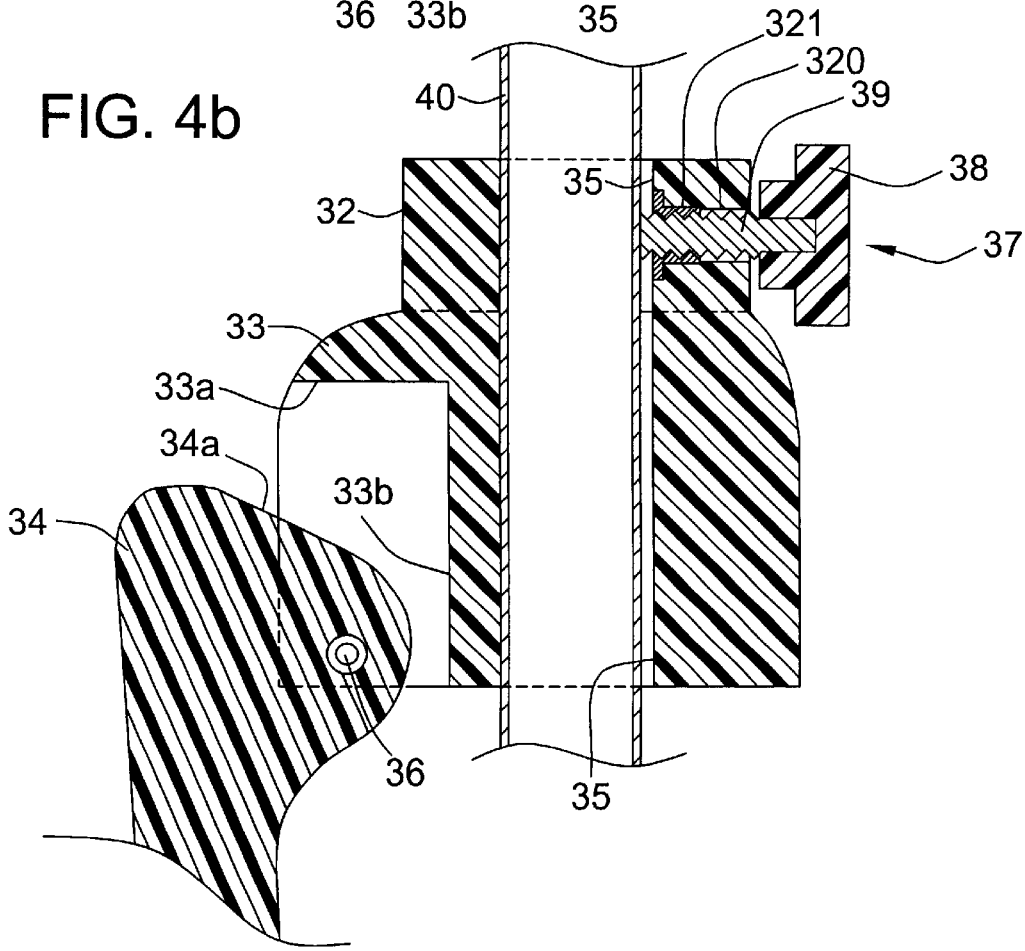

FIG. 3 illustrates a partially cut-away top view of the stand base 30 shown in FIG. 1. The stand base generally comprises a hub 32 having a plurality of legs 34 pivotally attached thereto. The hub 32 includes a plurality of sleeves 33 symmetrically spaced around the generally circular hub 32 corresponding with each of the plurality of legs 34. A rivet 36 extends through each sleeve 33 and leg 34 to pivotally mount the legs 34 to the central hub 32. As best seen in FIG. 4, the rivet 36 extends through an outer and lower portion of each sleeve 33, and a lower inner end of each leg 34. The sleeve 33 is marked by a recess defined by upper wall 33*a* and inner wall 33*b*, the sleeve 33 receiving an inner end of the leg 34. While other configurations can be employed within the scope of the invention, the illustrated configuration permits each leg 34 to rotate upwardly to a position where the inwardly facing surface 34*a* of the leg 34 engages the wall 33*b* of the sleeve 33 and limits further rotation (FIG. 4*a*). The shape of the legs inner end, as well as the positioning of the rivet 36 at a lower portion of the inner end, permits the leg 34 to rotate downwardly to a position at least substantially parallel with the central mast 40, if not to a position beyond parallel. FIG. 4*b* illustrates the leg 34 rotated downwardly to a generally parallel position. This parallel position is ideal for storage and transport, while the extended, generally traverse position (FIG. 4*a*) provides vertical and lateral support to the mast 40 and entertainer stand 20.

As also shown in FIGS. 3, 4*a* and 4*b*, the stand base 30, and more specifically the hub 32 includes a locking mechanism 37 for fixing the position of the hub 32 along the central mast 40. In the embodiment illustrated, the locking mechanism 37 generally comprises a knob 38 having a threaded rod 39 projecting therefrom which directly engages an outer surface of the mast 40. The hub 32 includes an aperture 320 having a threaded ring 321 contained therein. The knob 38 and threaded rod 39 are fed through aperture 320 and ring 321 to selectively position the threaded rod laterally, in and out of the central opening 35 formed in the hub 32 through which the mast 40 extends. While this simple locking mechanism 37 has been depicted in FIGS. 3, 4*a* and 4*b*, it will readily be understood that other locking mechanisms may easily be employed with equal efficacy, such as the quick-release mechanism as previously described with regard to the connector or coupler 50.

Referring again to FIG. 1, the instrument module 60 is depicted and generally includes a pair of feet 300 and a neck 61. The feet 300 are connected to two adjacent legs 34 and support the base of a guitar 68. The feet 300 are generally hooked shaped and include a jutting or upwardly turned distal end 301. The opposing end of each foot 300 is pivotally attached to the leg 34 via joint 302. Each foot 300 is pivotal about joint 302 such that the foot 300 may be positioned either generally parallel with the longitudinal axis of leg 34 (FIG. 10) or generally transverse to the longitudinal axis of leg 34. The transverse position of each foot 300 is such that the foot 300 is positioned to support a guitar 68 while the folded down parallel position is ideal for storing and transporting the entertainer stand 20. The neck 61 of the instrument module 60 generally includes a pivotable portion defined by a generally U-shaped or horseshoe-shaped free end 62. The opposing end 63 provides the structure about which neck 61 pivots, the end portion 63 having a quick release mechanism 64 which permits the neck 61 to be vertically adjusted along the central mast 40 as well as rotatably adjusted about the central support 40. To allow the free end 62 of neck 61 to pivot, a pin connection is utilized to connect the ends 62, 63, whereby a pin extends through each portion 62, 63. The non-pivoting portion 63 includes a vertical slot 65 for receiving the pin. Such a structure permits the neck 61, and more specifically the pivoting end 62 to be moved upwardly relative to the inner portion 63 and rotated downwardly to a position substantially parallel with the central support 40. This folded-down position is ideal for storage and transportation. The reverse steps may be used to place the neck 61 in an extended position, as illustrated in FIG. 1, for supporting the upper half of guitar 68. Other necks, supports, clamps and the like may also be employed in conjunction with the feet 300 (or alternately shaped feed) to provide a stand for other, differently shaped instruments without departing from the spirit of scope of the invention.

Figure 10:
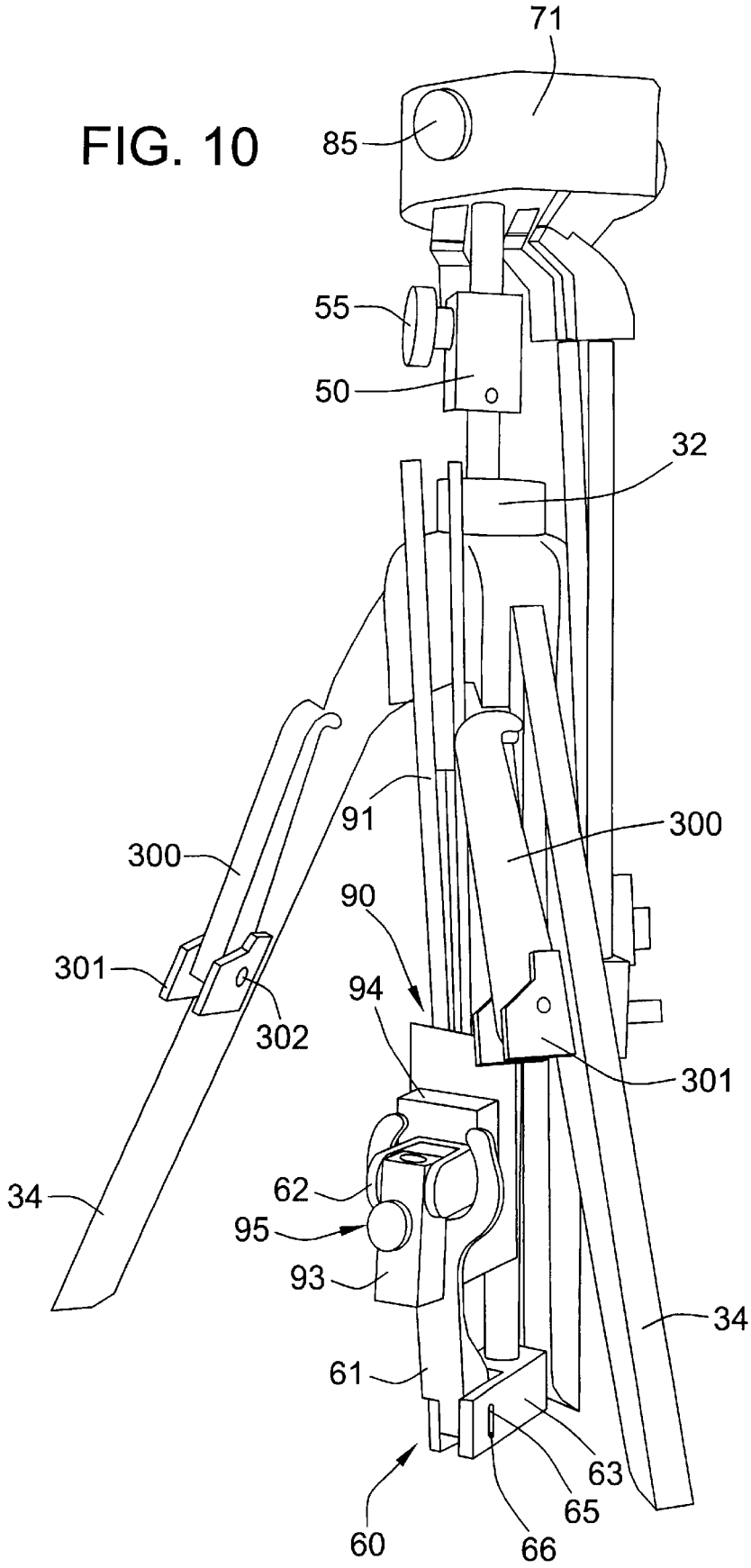
FIG. 10 is a perspective rear view of the entertainer stand depicted in FIG. 1 also in a compact configuration.

The music module 90 includes a folding easel 91, the details of which are well known in the art and will not be described in any further detail here. The music module 90 further includes a pivot body 92 attached to the easel 91 via a block 94 (FIG. 10). The pivot body 92 is pivotally attached to a sleeve 93, preferably taking the form of an elongated body 93 which includes a circular bore for receiving the mast 40. The sleeve or elongated body 93 includes a locking mechanism 95, such as a quick-release type mechanism, for frictionally engaging the mast 40. The locking mechanism 95 permits the elongated body 93, and hence the music easel 91, to be vertically adjusted along the mast 40, as well as rotated about the mast 40. These two degrees of freedom, coupled with the freedom of the easel 91 and pivot body 92 to pivot relative to the elongated body 93, permits the easel 91 to be positioned at any height or angle desired by a performer.

Figure 5:
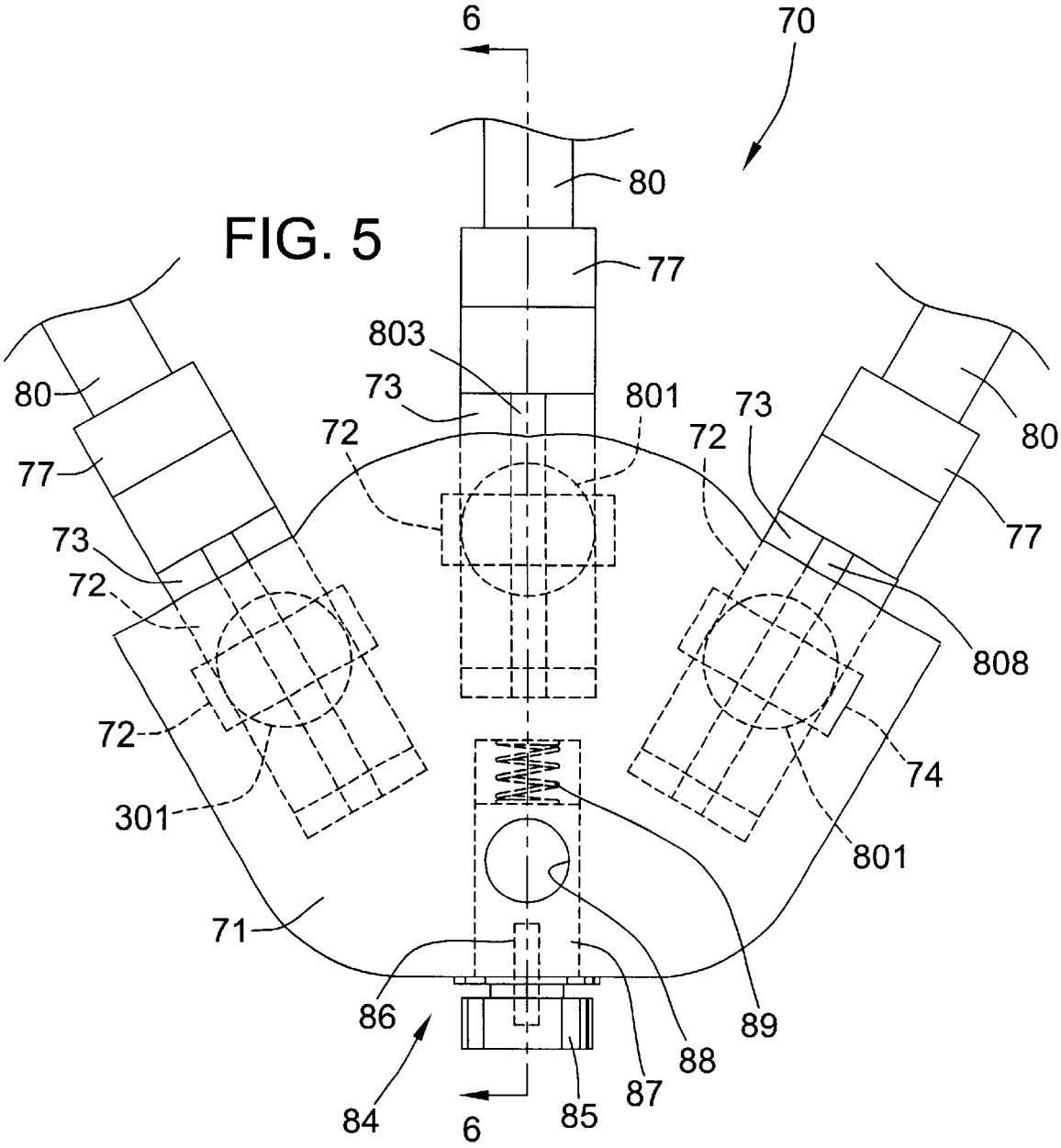
FIG. 5 is a top view, partially cut-away, of the microphone module depicted in FIG. 1.
Figure 6:
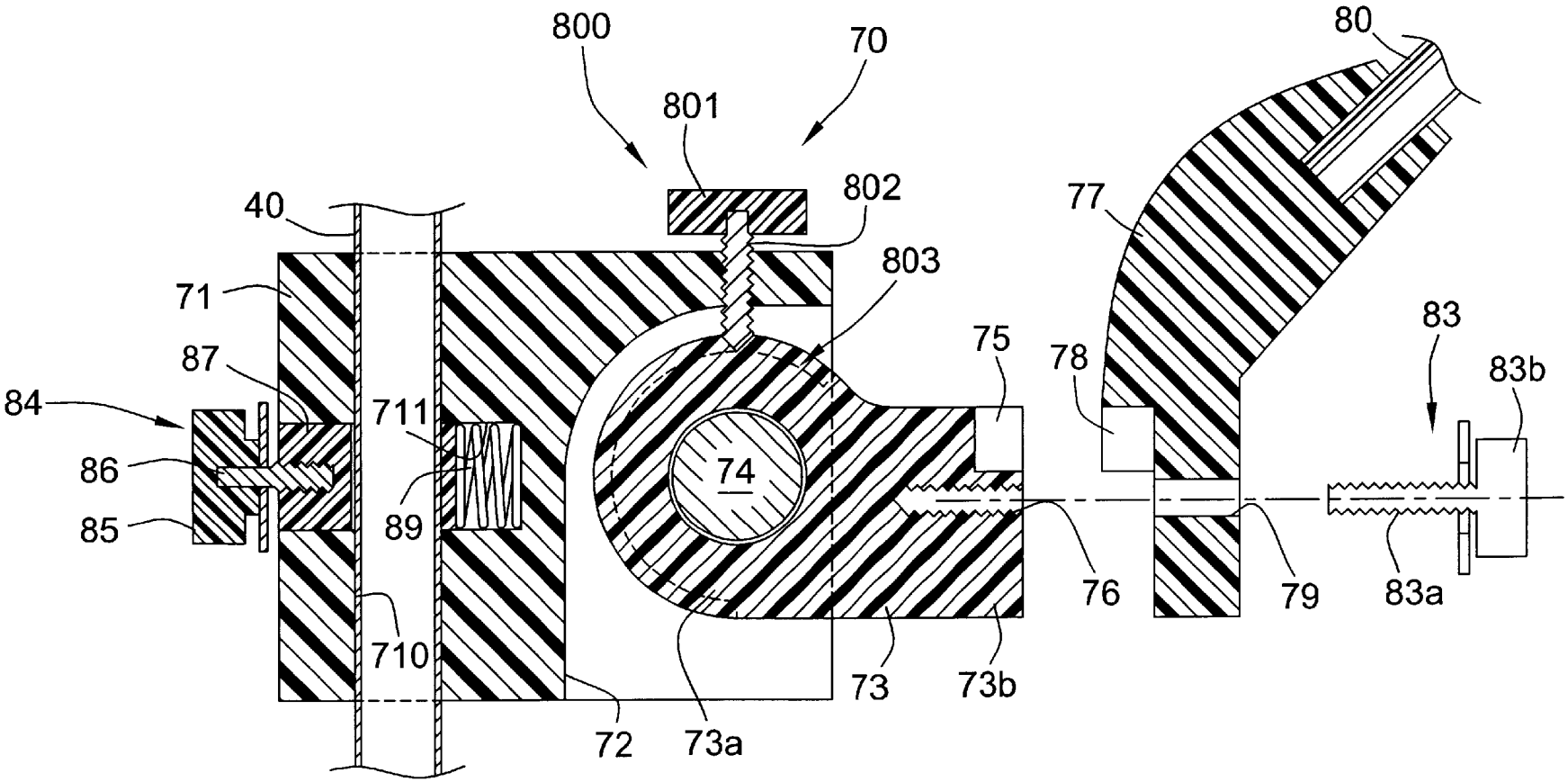
FIG. 6 is a cross-section view of the microphone module of FIG. 5.

According to another of the present invention, a plurality of microphones can be connected to the central mast and are independently adjustable such that a plurality of entertainers may utilize the entertainer stand 20. One embodiment is depicted in FIGS. 1, 5 and 6, wherein a microphone module 70 includes a main body 71 connected to the central mast 40, and preferably the upper mast portion 42. As shown in FIG. 1, the main body 71 generally supports a plurality of microphone booms 80, three booms 80 being depicted in the figure. Preferably, the microphone booms 80 may comprise a telescoping pair of tubes, similar to that of the central mast 40 having upper and lower mast portions 41, 42. As such, a plurality of couplers 81 may be utilized in conjunction with the microphone booms 80, the couplers 81 including a quick-release mechanism as previously described with regard to the coupler 50 of the central mast 40 and illustrated in detail in FIG. 2. Attached to the free end of the microphone booms 80 are a plurality of microphone holders 82 which are adapted to receive microphones (not shown), the microphone holders 82 being well known in the art.

A more detailed view of the main body 71 and its unique connection to the microphone booms 80 is shown in FIGS. 5 and 6. The main body 71 includes three recesses 72 which are each commonly sized to receive pivot bodies 73. The pivot bodies 73 are rotatably attached to the main body 71 by pin 74 about which the bodies 73 pivot. The microphone module 70 further includes a riser 77, one end of the riser 77 being pivotally attached to the pivot body 73, and the opposing end having the microphone boom 80 mounted thereto in any conventional manner. The riser 77 is angled away from the main body 71 and projects the microphone boom 80 outwardly and upwardly from the central mast 40 and main body 71. The riser 77 is attached to the pivot body 73 via a fastener 83 having a knob 83*b* and a threaded rod 83*a* which extends through a hole 79 formed in the riser 77 and screws into the internally threaded hole 76 in the pivot body 73. The pivot body 73 includes a serrated bushing 75 which provides a rough outer curved surface that corresponds with the inner curved surface 78 of the riser 77, thus allowing the screw 83 to be loosened, the riser 77 pivoted about the screw 83 and rotated, then locked back into place. By allowing the riser 77 to rotate relative to the pivot body 73, each individual microphone boom 80 and microphone (not shown) may be adjusted laterally as a specific situation demands by rotating the riser 77 about the horizontal axis if fastener 83.

The microphones and booms 80 may also be adjusted vertically, as the pivot bodies 73 rotate about a second horizontal axis defined by pin 74. The second horizontal axis is generally transverse to the horizontal axis of fastener 83. The pivot body 73 rotates about pin 74 within the recess 72 in the main body 71. The pivot body 73 generally comprises a rounded or curved portion 73*a* and a rectangular portion 73*b*. The rounded portion 73*a* of the pivot body 73 includes a groove 803 extending around a substantial portion of the curved perimeter (best seen in FIG. 9). The locking mechanism 800 includes a knob 801 and threaded fastener 802. The threaded fastener 802 extends through an upper surface of the main body 71 and may be screwed in and out of the main body 71 via knob 801 to selectively and frictionally engage the groove 803 on the pivot body 73. Accordingly, the position of the pivot body 73 may be adjusted and rotated about the pin 74 and selectively fixed in position via the threaded fastener 802 extending through the main body 71. Notably, the pivot body 73 may be rotated through approximately 180 degrees, including a downward position where the microphone boom 88 is generally parallel with the central mast 40, which is ideal when only using less than all microphones, as well as for storage and transport.

As also seen in FIGS. 5 and 6, the main body 71 includes a locking mechanism 84 which is of the quick-release type, although somewhat different than the quick-release locking mechanism 54 depicted in FIG. 2. The locking mechanism 84 generally includes a knob 85 having a threaded rod 86 projected therefrom, a cylindrical body 87 and a spring 89. As in the prior embodiment, the cylindrical body 87 includes a cylindrical bore 88 extending through the cylinder transverse to its longitudinal axis. The cylindrical bore 88 corresponds with a vertical hole 710 (FIG. 6) extending through the main body 71 for receiving the mast 40. The main body 71 further includes a horizontal hole 711 which intersects with vertical hole 710. Spring 89 is positioned within the cylindrical hole 711 as is the cylindrical body 87 of the locking mechanism 84. Spring 89 is placed in compression, acting upon an end of cylinder 87 to force the cylinder outwardly. The hole 88 of cylinder 87 is aligned with vertical hole 710, and the mast 40 is fed therethrough. The outwardly biasing force on cylinder 87 forces the inner walls of its hole 88 to press against the outer surface of mast 40, forcing the opposite side of the outer surface of mast 40 against the wall of hole 710 in the main body 71. By merely pressing inwardly on the knob 85, the biasing force of the spring 89 is acted against, and the holes 88 and 710 may be aligned to permit the main body 71 to slide vertically along mast 40, as well as rotate about mast 40. Upon releasing the button or knob 85, the spring 89 will cause the locking mechanism 84 to engage the mast 40, thereby fixing the position of the main body 71 and microphone module 70.

Another embodiment of a microphone module 70' is depicted in FIGS. 7*a*, 7*b*, 7*c* and 7*d*. The microphone module 70' this embodiment generally comprises a first body 701 (FIG. 7*d*) and a second body 702 (FIG. 7*c*). The second body 702 includes an elongated tubular portion 703 having a bore 704 defined therein, and a curved, generally semicircular portion 705 which includes a central aperture 706 and a series of small holes 707 spaced about the outer perimeter of the curved portion 705. The first body 701 also has a correspondingly curved or semicircular end 710 which also includes a centrally located aperture 711. The opposite end of the first body 701 includes a connector 712 attached in a threaded hole 713 of the body 701. The connector 712 may be adapted with internal or external threads, or any other connection structure for attaching a microphone boom and microphone thereto. For example, FIG. 7*a* depicts a flexible boom 80', also known as a gooseneck, for linking a microphone (not shown) to the first body 701 of microphone module 70'. The first and second bodies 701, 702 may be equated with the main body 71 and pivot body 73 of the prior embodiment, as the first body 701 supports a microphone and rotates relative to the second body 702 on the mast 40.

As best seen in FIG. 7*b*, the first body 701 includes a slot 714 defined within the semicircular curved end 710 which is sized to receive the curved portion 705 of the second body 702. The first and second bodies 701, 702 are connected via a pin 715 extending through the circular apertures 706 and 711 in the bodies 701, 702. By virtue of their curved nature, the first and second bodies 701, 702 may rotate relative to one another about the pin or rivet 715. As also best seen in FIG. 7*b*, a locking means 720 is provided for fixing the position of the first and second bodies 701, 702 relative to one another. In the present embodiment, the locking mechanism 720 includes a push button 721 which is received in a slot 722 formed in the first body 701, and is biased outwardly from the slot via a spring 723. The spring 723 is coiled around a rod 724 which is fixed between the push button 721 and a plate 725. The rod 724 projects through a small hole 726 (FIG. 7*d*) in the outer surface of the first body 701, the spring forcing the plate 725 against the outer surface of the first body 701. The plate 725 has a second rod 727 attached to an end of the plate opposite rod 724 and projecting through a second hole 728 formed in the first body 701 and extending into the slot 714 within the first body 701. Rod 727 extends to a position corresponding with the small holes 707 extending around the perimeter of the second body 702 which is disposed within the slot 714.

Accordingly, by manually pushing button 721 against the force of spring 723, rod 724 pushes on plate 725 which also pulls rod 727 outwardly from the bodies 701, 702 freeing the second body 702 to rotate about rivet 715. When the push button 721 is released, the spring 723 pushes against the button 721 which causes the plate 725 to move back towards the bodies 701, 702, including the rod 727 which is positioned to engage one of the small holes 707 in the second body 702. Thus, by pressing the button 721, the bodies 701 and 702 may be rotated relative to one another, and hence a microphone (not shown) attached to the connector 712 on body 701 may be vertically adjusted. The second body 702 which includes an elongated tubular portion 703 includes bore 704 which receives the central mast 40 and is vertically adjustable along the mast 40. A locking mechanism 730 depicted as knob 733 having threaded rod 732 may threadingly engage an aperture 731 in the second body 702 to frictionally engage the central mast 40 and fix the vertical position of the microphone module 70'.

By use of such a microphone module 70', the vertical height of a microphone may be fixed in discrete positions according to the small hole 707 in the second body 702 of the module 70'. A plurality of these modules 70' may be utilized to accomplish the same objectives as the embodiment of microphone module 70' depicted in FIGS. 5 and 6. For example, the locking mechanism 730 permits the module 70' to be vertically adjustable along the central mast 40. The locking mechanism 730 also allows the microphone module 70' to be rotated about the central mast 40. Finally, when the second body 702 is fixed to the central mast 40, the first body 701 is pivotable relative to the second body 702 and central mast 40 via the locking mechanism 720. Therefore, when a plurality of microphone modules 70' are utilized, each microphone is independently adjustable relative to the other microphones, and is adjustable in at least three directions including vertically, rotationally about a vertical axis (mast 40), and rotatably about a horizontal axis (rivet 715).

Figure 8A:
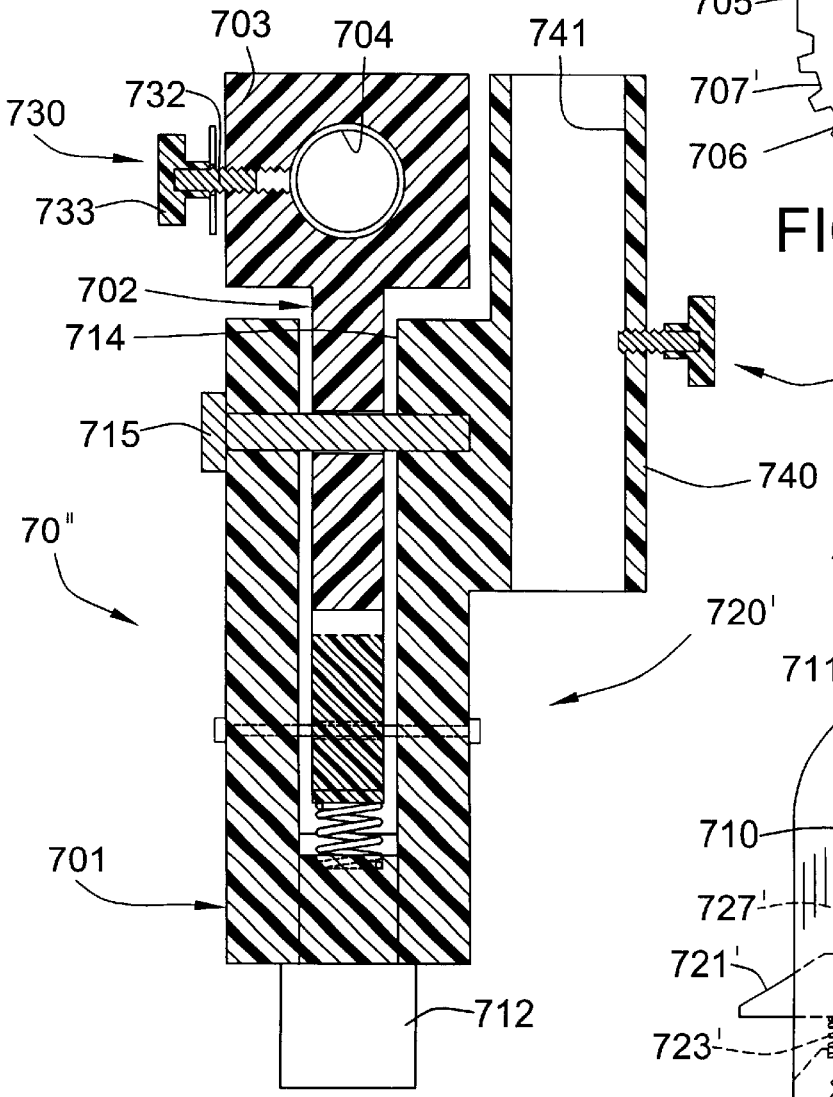
FIGS. 8*a*, 8*b* and 8*c* depict yet another embodiment of a microphone module constructed in accordance with the teachings of the present invention.
Figure 8B:
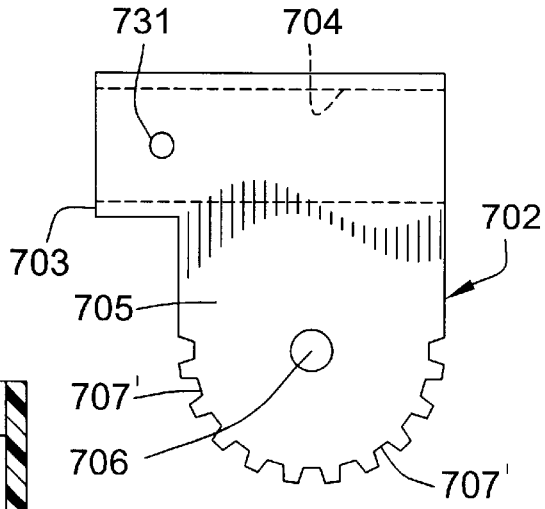
Figure 8C:
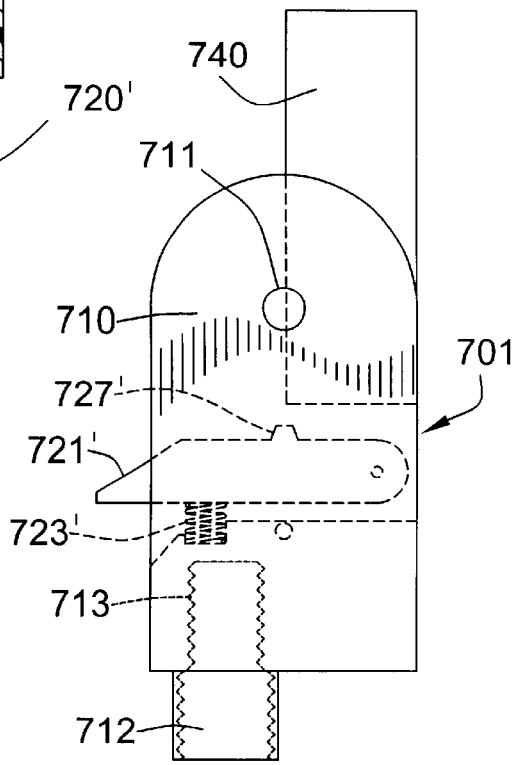

Another embodiment of a microphone module 70" is disclosed in FIGS. 8*a*, 8*b*, 8*c*. The microphone module 70" is substantially similar to the microphone module 70' depicted in FIGS. 7*a*, 7*b*, 7*c* and 7*d*. Like parts will be given like numbers in FIGS. 8*a*, 8*b* and 8*c*. The primary difference relates to the means for locking the position of the first body 701 relative to the second body 702 in this embodiment. The second body 702 includes a series of notches and grooves 707' around a peripheral edge of the curved semi-circular portion 705. The first body 701 includes a lever 721' which is biased by a spring 723' towards the second body 702. The lever 721' is pivotally mounted about a pin 725'. The lever 721' includes a centrally disposed boss or projection 727' which is sized to correspond with the grooves 707' and the second body 702. It can therefore be seen, that the spring 723' biases the projection 727' into a groove 707' of the second body, fixing the relative positions of the first and second bodies 701, 702. To permit rotation of the first body 701, the lever 721' is manually depressed against the force of the spring 723', removing the projection 727' from a groove 707.

It can also be seen that the first body 701 includes an appended tubular body having a bore 741 sized to correspond with hole 704 and the central mast 40. The appended tubular body 740 includes a locking mechanism 742, similar to any of those described above, for locking the position of tubular body 740 and hence first body 701 along any tube extending through hole 741. By virtue of the appended tubular body 740, either the first body 701 or second body 702 may be selectively attached to the central mast 40 or any other supporting mast. For example, the appended tubular body 740 may be used to attach the first body 701 to the central mast 40, while the second body 702 receives a boom for supporting and suspending a microphone. Alternately, the second body 702 may be connected to the central mast 40, and two microphone booms may be attached to first body 701 by virtue of connector 712 and appended tubular body 740.

Figure 9:
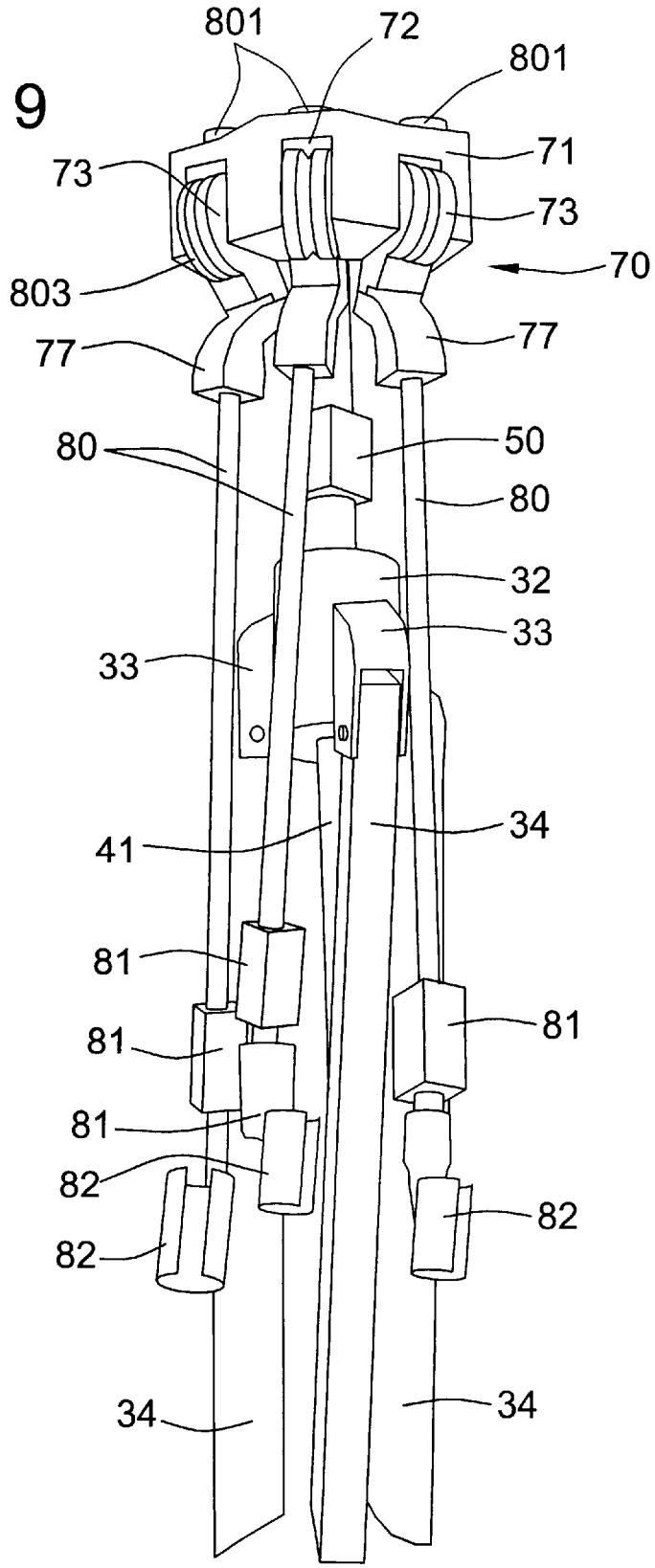
FIG. 9 is a perspective front view of the entertainer stand depicted in FIG. 1 in a compact configuration.

According to another aspect of the present invention, the entertainer stand 20 may be folded or otherwise collapsed into a compact configuration that is suitable for storage and transportation, which is important in the entertaining industry. A carrying case (not shown) sized to carry the folded down entertainer stand may be employed for ease of transporting the entertainer stand 20. FIGS. 9 and 10 show such a configuration. In its compact configuration, the entertainer stand 20 has each of its microphone booms 80 and attachments thereto folded downwardly such that the booms 80 are substantially parallel with the central mast 40. The central mast 40 is also reduced in size by utilizing quick-release mechanism 54 on coupler 50 to permit upper mast portion 52 to telescope down into lower mast portion 41. Therefore, the main body 71 of microphone module 70 is moved downwardly, proximate to the coupler 50. The hub 32 of the stand base 30 is also moved upwardly along the mast 40, and more particularly along the lower mast 41 towards the coupler 50. In this position, the legs 34 pivotally attached to the sleeves 33 are permitted to rotate downwardly to positions generally parallel with the central mast 40. It is also important to note that the legs 34 also extend downwardly from the hub 32 a distance substantially corresponding to the remaining length of central mast 40.

A view of the compact configuration from the opposite side of FIG. 9 is shown in FIG. 10. Two of the legs 34 have been shown as rotated partially outwardly in FIG. 10 to reveal the music stand module 90 and neck portion 61 of the instrument stand module 60 within. The neck portion 61, and more specifically the end portion 63 having a cylindrical hole therethrough has been removed from the upper mast portion 42 and placed on the bottom distal end portion of the mast 40. The neck 61 including its horseshoe shaped free end 62 has been folded upwardly, substantially parallel with the central mast 40. In this position, the arm 61 and horseshoe end 62 can support the folded up music easel 91 in a substantially vertical position parallel with the central mast 40 by engaging the elongated body 93, pivot body 92 and block 94 which normally are used to connect the unfolded easel 91 to the central mast 40. Alternately, the tubular body 93 of the music module 90 may be attached to a downward end of the mast 40 above or below the neck 61 . The legs 34 may be folded down around the music stand module 90 and neck portion 61 to provide a compact configuration.

Figure 11:
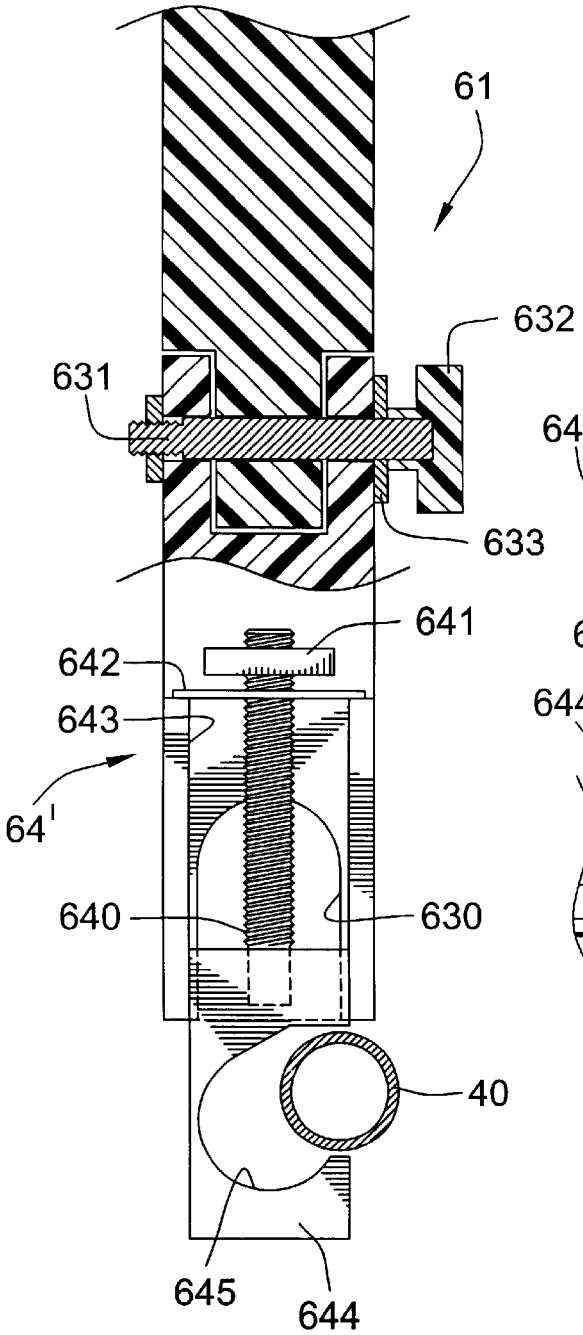
FIG. 11 is a partially cut-away side view of an alternate embodiment of an instrument support neck constructed in accordance with the present invention.
Figure 12:
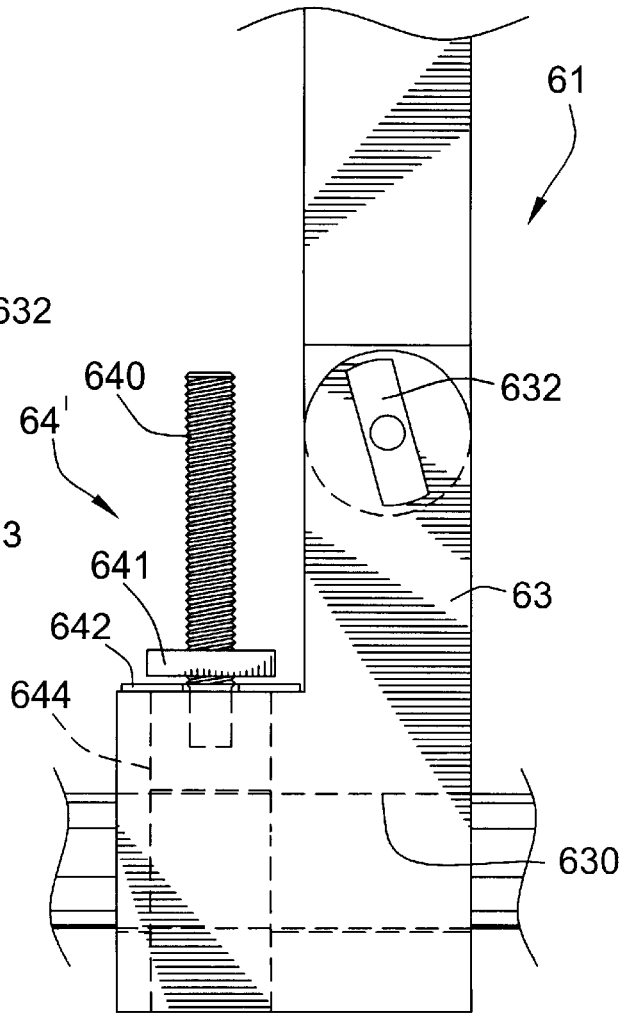
FIG. 12 is a top view of the neck of FIG. 11.

Yet another locking mechanism may be utilized to facilitate the assembly and disassembly of the entertainer stand 20 into a compact configuration as discussed above. FIGS. 11 and 12 illustrate partially cut-away side and top views of the neck 61 of the instrument module employing an alternate locking mechanism 64'. Notably, this embodiment of the locking mechanism 64' permits the neck 61 (or any other component of the stand 20 which may easily be modified to use this mechanism) to be attached to and removed from the central mast 40 without being slid off an end of the mast. Rather, the component may be attached/detached at any desired point along the mast 40. To these ends, the locking mechanism 64' employs a peg 644 which slides substantially out of a hole 643 in the end 63 of the neck 61, and includes a laterally opening slot 645 for selectively receiving the mast 40.

As shown in FIGS. 11 and 12, the neck 61 of this embodiment has an end 63 adapted for attachment to the central mast 40, the opposing end being pivotally attached to end 63 by a rod 631 passing through the neck 61. The rod 631 passes through a washer 633 and attaches to a knob 632 for loosening and tightening the pivotal joiner of the free end of the neck 61 and the attached end 63.

A threaded rod 640 projects from the peg 644 and extends through a washer 642 to be threadingly received by a rotatable knob 641 having a threaded hole therein. When the knob 641 is rotated about the threaded rod 640 and positioned adjacent the rod's free end, as shown in FIG. 11, the peg 644 may be slid outwardly from the end 63 and its hole 643. FIG. 11 also shows that the end 63 further includes an outwardly opening or U-shaped slot 630 sized to receive the mast 40. When the peg 644 is extended (FIG. 11) the peg's laterally opening slot 645 can be accessed and the mast 40 positioned therein. The peg 644 may then be drawn back into the hole 643 in end 63, causing the mast 40 to be drawn into the outwardly opening slot 630. The knob 641 may then be rotated to tighten the locking mechanism 64' such that the mast 40 is held securely between the inner surface of the peg's hole 645 and the inner surface of the U-shaped slot 630 in the neck's end 63, as is shown in FIG. 12. It will be readily recognized that the locking mechanism 64' may be oriented to project the peg 644 away from the component along any axis, that the mechanism 64' may be spring-loaded (i.e. the peg 644 biased by a spring) as in prior embodiment (s) of locking mechanisms, and that alternately shaped knobs 641, washers 642, rods 640 or pegs 644 may be employed without departing from the scope and spirit of the present invention.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An entertainer stand comprising:

a central mast;

a base comprising a hub connected to the central mast and a plurality of legs pivotally attached to the hub for supporting the stand;

a microphone module comprising a main body connected to the central mast and vertically adjustable along the central mast, and a pivot body pivotally attached to the main body for supporting a microphone; and a music module comprising a music easel pivotally attached to the central mast.

2. The entertainer stand of claim 1, further comprising an instrument module comprising a pair of feet pivotally attached to a pair of legs for supporting an instrument.

3. The entertainer stand of claim 2, wherein the instrument module further comprises a neck attached to the central mast and cooperating with the feet to provide instrument support.

4. The entertainer stand of claim 2, wherein the feet have a general hook-shape defined by a jutted distal end.

5. The entertainer stand of claim 2, wherein the feet are spaced and sized to receive the base of a guitar therebetween.

6. The entertainer stand of claim 1, wherein the easel is pivotally attached to a sleeve connected to the central support, the sleeve being rotatably adjustable about the central support.

7. The entertainer stand of claim 1, wherein the main body is rotatably adjustable about the central mast.

8. The entertainer stand of claim 1, the microphone module further comprising a plurality of pivot bodies pivotally attached to the main body for supporting a plurality of microphones.

9. The entertainer stand of claim 8, wherein the plurality of pivot bodies are pivotal about a plurality of first axes normal to the central mast.

10. The entertainer stand of claim 9, the microphone module further comprising a plurality of risers pivotally attached to the plurality of pivot bodies, the risers for supporting a plurality of microphones.

11. The entertainer stand of claim 10, wherein the plurality of risers are pivotal about a plurality of second axes normal to the plurality of first axes.

12. The entertainer stand of claim 1, wherein the microphone module further comprises a plurality of main bodies and a plurality of pivot bodies pivotally attached to the main bodies.

13. The entertainer stand of claim 1, wherein the mast comprises at least two telescoping tubes vertically adjustable relative to each other.

14. The entertainer stand of claim 1, wherein the legs are each pivotal between a storing position generally parallel with the central mast, and a supporting position non-parallel with the central mast.

15. The entertainer stand of claim 2, wherein the feet are each pivotal between a storing position generally parallel with the legs, and a supporting position non-parallel with the legs.

16. The entertainer stand of claim 1, wherein the hub is vertically adjustable along the central mast.

17. The entertainer stand of claim 3, wherein the neck is vertically adjustable along the central mast.

18. The entertainer stand of claim 3, wherein the neck is pivotally attached to the central mast and pivotal between a storing position generally parallel with the central mast, and a supporting position non-parallel with the central mast.

19. The entertainer stand of claim 1, wherein the easel is pivotally attached to a sleeve connected to the central support, the sleeve being vertically adjustable along the central support.

20. The entertainer stand of claim 1, wherein at least one of the hub, the main body, and the music easel includes a locking mechanism for selectively engaging the central mast to fix position.

21. The entertainer stand of claim 20, wherein the locking mechanism comprises a peg having a hole therethrough for receiving the central mast, the peg fitting in an aperture formed in at least one of the hub, the main body, the neck, and the music easel and communicating with a bore therein which receives the central mast, the locking mechanism including means for controlling the position of the peg within the aperture.

* * * * *